United States Patent [19]

Wilson

[11] 4,050,580

[45] Sept. 27, 1977

[54] PROCESS CONTAINER

[76] Inventor: William Wilson, 716 Scott St., Stroudsburg, Pa. 18360

[21] Appl. No.: 546,354

[22] Filed: Feb. 3, 1975

Related U.S. Application Data

[62] Division of Ser. No. 321,436, Jan. 5, 1973, abandoned.

[51] Int. Cl.[2] ..... B65D 21/02; B65D 19/08; B65D 7/34

[52] U.S. Cl. ..... 206/511; 108/55.1; 206/386; 220/1.5; 220/71

[58] Field of Search ..... 206/508, 509, 512, 386, 206/821, 511, 508; 220/71, 72, 84, 1.5, 80, 81 R, 75; 108/55.1, 55.3, 55.5; 217/43 A

[56] References Cited

U.S. PATENT DOCUMENTS

| | | | |
|---|---|---|---|
| 1,252,489 | 1/1918 | Pearson | 220/80 |
| 2,322,704 | 6/1943 | Seltzer | 220/71 |
| 2,607,509 | 8/1952 | Hess | 220/72 |
| 2,985,482 | 5/1961 | Lion | 220/1.5 |
| 3,185,516 | 5/1965 | Johansson | 220/84 |
| 3,208,619 | 8/1965 | Kridle | 220/84 |
| 3,347,412 | 10/1967 | McKinney | 220/1.5 |
| 3,586,204 | 6/1971 | Roper | 206/512 |
| 3,587,904 | 6/1971 | Harris | 206/509 |
| 3,702,676 | 11/1972 | Stephens | 108/55.1 |
| 3,797,691 | 3/1974 | Williams | 220/1.5 |

FOREIGN PATENT DOCUMENTS

| | | | |
|---|---|---|---|
| 1,208,686 | 2/1960 | France | 220/80 |
| 1,504,692 | 10/1967 | France | 206/508 |

*Primary Examiner*—George E. Lowrance
*Attorney, Agent, or Firm*—Stuart E. Beck

[57] ABSTRACT

Apparatus and a system are disclosed for storing and transporting material as well as conducting required batch processing operations on the material within a container having exterior fittings designed for use in conjunction with a quick connect-disconnect docking station. A member of the docking station interlocks with containers of different size in a positive self-positioning manner. Blending, mixing, chemical reaction, and reconstituting of liquid and/or solid material in the container or inverting of the container itself can then be accomplished without having to transfer the material to additional process equipment. In addition to the significant materials handling advantages obtained, the apparatus and system virtually eliminate pollution and contamination problems for batch processing operations.

10 Claims, 11 Drawing Figures

Fig. 7
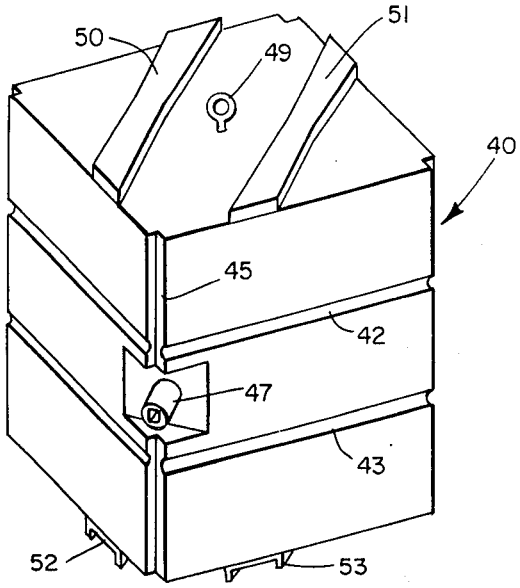
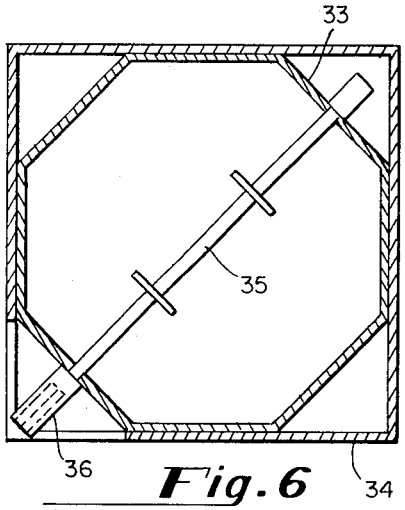
Fig. 6
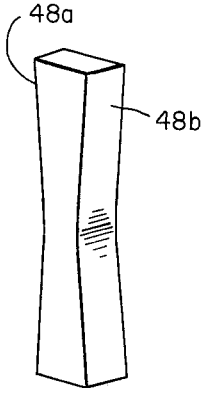
Fig. 9
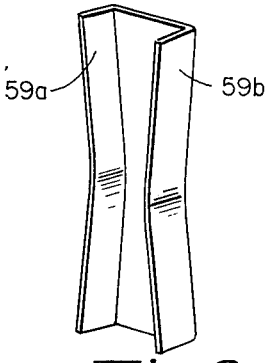
Fig. 8
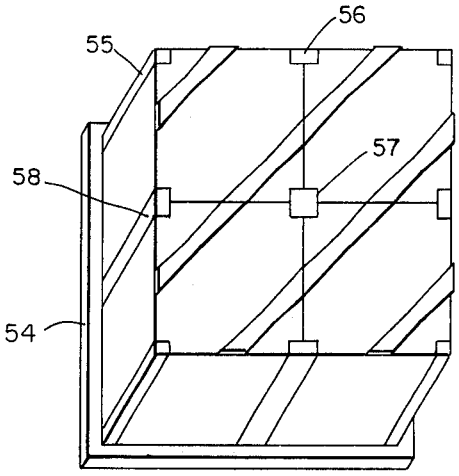
Fig. 10
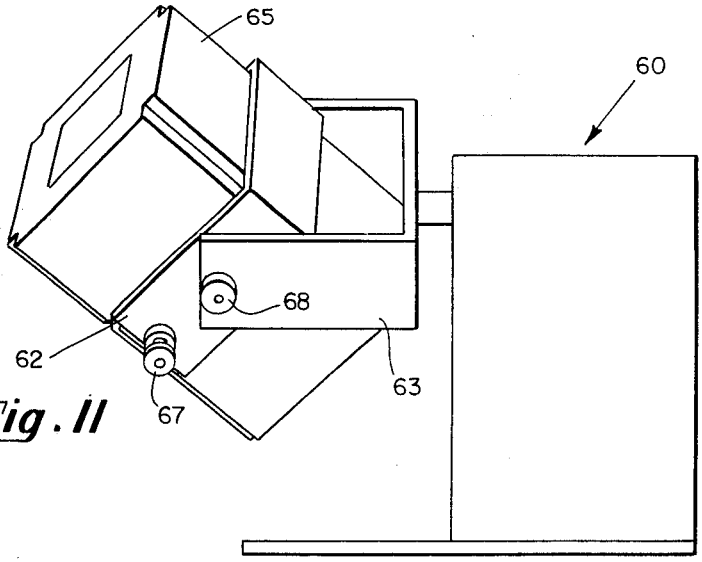
Fig. 11

PROCESS CONTAINER

CROSS REFERENCE TO RELATED APPLICATION

This is a division of U.S. Ser. No. 321,436, filed Jan. 5, 1973, now abandoned.

FIELD OF THE INVENTION

The present invention relates to a process container apparatus and system and, more particularly, to apparatus and a system for obtaining improved materials handling by storing and transporting material as well as conducting required batch processing operations on the material within the same container.

BACKGROUND OF THE INVENTION

Conventionally, industrial mixing devices have been permanently located. Utilization of such equipment has accordingly required that material to be mixed or blended be transported to the mixing devices, removed from one or more storage containers, inserted into the mixing devices, mixed or blended, removed from the mixing devices and placed inside new storage or shipping containers. Of course, the mixing devices must be cleaned at least periodically and normally after every batch operation. These various operations obviously require considerable time and labor in addition to creating storage problems for containers. Completely automated systems for batch type operations can be devised but tend to be somewhat rare. Not only are automated systems costly, but such automation tends to defeat flexibility — an inherent advantage of batch operations.

In addition to the time and expense involved with materials handling aspects of batch type operations, the problem of contamination and pollution control are very significant. In industries such as the pharmaceutical industry and food industry product purity is synonymous with product quality. The very real and serious hazards which can occur by cross contamination of pharmaceutical ingredients have led the Food and Drug Administration of the U.S. Goverment to require very rigid housekeeping efforts to eliminate contamination problems. This has meant that equipment such as mixing equipment which is used to perform its function with a variety of product formulations must be cleaned laboriously between runs of different material. The problem, however, involves more than simply the time consuming effort required to clean previously used containers and mixing equipment. Part of the existing problem is the exposure of material to plant environment, including solid materials and vapors, and the effort required to prevent migration of material either into the plant environment or of impurities into the material from the plant environment. Environment control is exceedingly difficult when material is being transferred back and forth between containers and processing equipment. The solutions which have been suggested for combating problems of contamination and environmental pollution, including such practices as segregation of different product operations, utilization of vacuum systems to combat dust problems, and the like, all have recognized limitations.

Included among the various devices and procedures which have been proposed for handling both solid and liquid materials in an attempt to obtain improved handling procedures are those proposed by Schmitt and Wheeler. U.S. Letters Patent No. 3,315,945, to Alfred Schmitt as well as U.S. Letters Patent No. 3,090,604, to Delbert Wheeler, involve equipment designed to be used in conjunction with a standard 55 gallon metal drum for mixing the contents of the drum. According to the Schmitt patent, the metal drum must be clamped to a circular frame which is then rotated in order to accomplish some form of mixing. The Wheeler patent also involves means for securing a metal drum to a frame which is then moved to accomplish some form of mixing action. The objective in both the Schmitt and Wheeler patents is to position a standard industrial drum at an angle which will promote efficient mixing of the container contents. Movement of a 55 gallon industrial drum containing granular powder or liquid material, however, can be very difficult even with leverage applied to the drum. There is simply no convenient or quick way of mounting a 55 gallon industrial drum in the apparatus taught by Schmitt and Wheeler or of introducing variations in drum size.

Suppliers of specialized storage containers have also offered some improvement in the materials handling aspects of batch processing apparatus. Today portable bins of various kinds are frequently employed for charging and discharging process machines, transferring materials between processing machines and storing materials, including the raw materials, intermediates and final product. In reality, such bins are simply glorified versions of the standard 55 gallon metal drum which has conventionally been used in industry for storing and shipping liquids and dry bulk material. For convenience, the portable bins are normally equipped with resealable openings, piping to facilitate removal of contents, and corner extensions which permit stacking the bins during shipment or storage. Notwithstanding the use of specially designed storage containers, charging and discharging the containers remains time consuming, costly, dirty and troublesome and it has been almost impossible in batch type operations to approximate the coordination of storage, movement and processing that is taken for granted in continuous operation.

Another approach which has been proposed in order to reduce capital equipment costs and improve overall efficiency has been to employ multiple cone blenders in conjunction with one drive unit. Use of cone type hoppers which can be bolted one at a time to a single drive unit has helped to reduce capital investment costs in some operations, but has not overcome contamination, storage, transfer, interplant shipment and cleaning problems. Of course, the drive unit can only be used with a fixed hopper size.

Process container apparatus and a system have now been developed which provide clean, safe, economical and flexible materials handling for batch type operations. By improving the materials handling aspects of batch operations the efficiency of an entire manufacturing operation can be improved.

SUMMARY OF THE INVENTION

An object of the invention is to provide apparatus and a system for improving liquid and/or solid materials handling procedures, particularly in batch type operations.

Another object of the present invention is to provide apparatus and a system which can be economically and conveniently employed for multiple functions.

Still another object of the present invention is to provide apparatus and a system which can be used for storing, transporting and mixing materials in a clean, safe and flexible manner.

Yet another object of the present invention is to provide apparatus and a system which will reduce exposure of material and thereby virtually eliminate contamination, pollution, safety and corrosion problems in batch type materials handling operations.

In accordance with the present invention apparatus and a system are provided for storing and transporting materials and conducting required batch type processing operations on the materials within the same container. The system utilizes a container having fittings designed for use in conjunction with a quick-disconnect docking station. The docking station not only causes the container to be positioned at a precise location, but can be used to accomplish mixing or blending of material inside the container without requiring material to be removed from the container. In a preferred embodiment the fittings on the container are recessed grooves adapted to become engaged with corresponding projections located on arms of the docking station. The fittings on the container provide the right angle, irrespective of the interior shape of the container, which matches the fittings of the docking station. In another preferred embodiment the container is equipped with a mixing bar capable of rotation which becomes engaged once the container is connected to the docking station. A further embodiment provides hour-glass shaped channels on the container for use in lifting, transporting and positioning the container as well as for stacking and interlocking multiple containers.

BRIEF DESCRIPTION OF THE DRAWINGS

Other and further objects, advantages and features of the invention will be apparent to those skilled in the art from the following detailed description thereof, taken in conjunction with the accompanying drawings, in which:

FIG. 6 is a top view in cross section of an octagonally shaped container equipped with a square frame adapted for use in the present invention and further illustrates a removable rotating bar present in the container which can be engaged when the container is placed in a docking station;

FIG. 7 is a perspective view of a container designed for use in the present invention which illustrates certain structural aspects which can be incorporated into the container, including a lifting hook, interlocking channels and the outside connection for an internal mixing bar, such as that illustrated in FIG. 6;

FIGS. 8 and 9 are diagrammatic drawings which illustrate the preferred hour-glass shape of the channel members used for stacking and interlocking containers in accordance with the present invention, the channel member illustrated in FIG. 9 being expressly designed to be attached to the top of the container and the receiving channel member illustrated by FIG. 8 being designed to be attached to the bottom of the container;

FIG. 10 is a perspective drawing which illustrates the interlocking of multiple containers on a pallet; and FIG. 11 is a side view of a docking station interlocked with a container, in which the docking station has U shaped movable arms for positioning the container to the optimum angle for mixing.

DESCRIPTION OF THE PREFERRED EMBODIMENTS

In accordance with the present invention one container can be used for storage and transportation of material as well as the processing of the material thereby providing clean, safe, economical and flexible materials handling. Utilization of one container for these different functions means that product contamination is virtually eliminated, pollution problems are minimized, there is a reduction in cost, time and handling problems, there is a reduction of required cleaning operations and a resulting improvement in safety. Safety in handling materials is of course of particular concern in dealing with explosives, corrosive materials, poisonous materials and also materials which involve physiological hazards. While product contamination is perhaps of primary concern in connection with the pharmaceutical and food processing industry, the reduction in overall plant housekeeping activities as well as reduction in cost of plant equipment is of significance to every industry.

Figure 1:
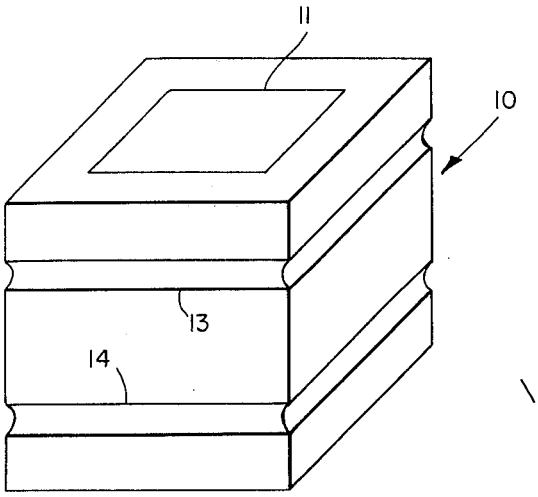
FIG. 1 is a perspective view of a container designed for use in connection with the present invention, having recessed fittings located along at least two sides of the container.
Figure 3:
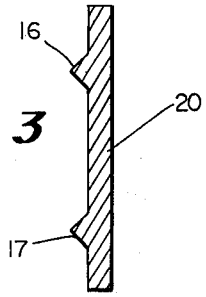
FIG. 3 is a side view in cross section along 3—3 of FIG. 2, illustrating the rails on arms of the docking station which connect with the fittings of containers used in the process of the invention.

Referring to FIG. 1, the containers which can be utilized in accordance with the present invention can be of almost any shape provided that at least two sides of the container are equipped with a frame having fittings adapted for connection with a docking station, as hereinafter described. Container 10 illustrated in FIG. 1 is a square container which is equipped with any desired number, shape and size of openings, such as opening 11, which will facilitate the transfer of materials to and from the container. Parallel grooves 13 and 14 are illustrated as recessed fittings on at least two sides of container 10 and these grooves are designed to interconnect with rails projecting from arms of the docking station illustrated in FIG. 2. As seen in FIG. 3, rails 16 and 17 projecting from arms 20 of the docking station are spaced exactly the same distance apart as parallel grooves 13 and 14 of container 10. Accordingly, when container 10 is connected with docking station 18 two side walls of container 10 contact arms 20 and 21 of docking station 18.

Figure 2:
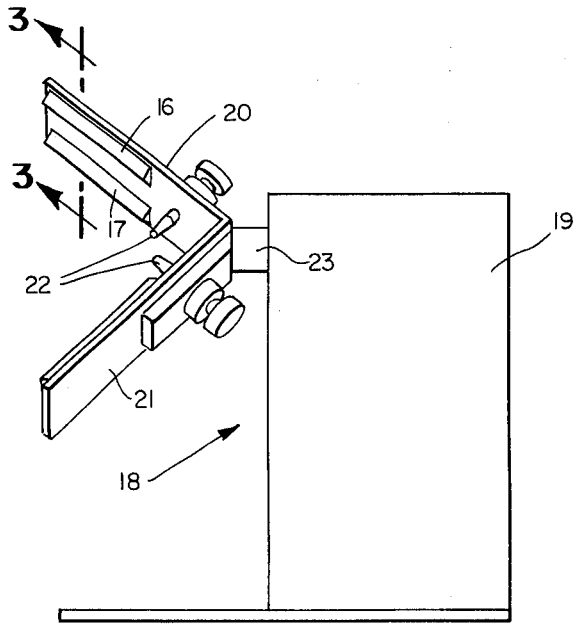
FIG. 2 is a side view of a docking station in accordance with the present invention which is designed for quick and positive connection with a container, such as the containeer illustrated in FIG. 1.

Fittings such as grooves 13 and 14 are recessed in order to avoid any protrusions on the outside of container 10 which would interfere with the transportation, storage or other utilization of the container. In special cases, however, members could be welded onto the side of a container to provide fittings required for connection with corresponding recessed fittings on the docking station. Obviously, the shape and number of rail members 16 and 17, which become engaged in grooves 13 and 14, can be varied. Preferably, at least two rails are present and these rails are shown in FIG. 2 as triangular in shape. Other rail shapes can obviously be used, including rails trapezoid in shape, half rounded in shape and even rectangular in shape. Provided a uniform distance between container fittings is maintained any number of containers can be used in conjunction with the same docking station. It will be seen that container 10 becomes firmly interconnected with docking station 18.

Once the container is in position it can be securely locked in place by suitable mechanically, electrically or hydraulically actuated wedges or other means, such as taper pins 22—22 shown in FIG. 2. Taper pins 22 are retracted until a container has been positioned in the docking station andthen said pins are actuated by suitable means to engage the container and lock it securely to the arms of the docking station. This locking assures positive engagement of the triangular rails 16 and 17 with the triangular grooves 13 and 14 of the container. Locking normally required if the container is to be rotated by the docking station. For extreme protection, a band strap, or retaining arm could be clamped to or around the container after it has been connected to the docking station. However, such precautionary measures are normally required only in instances where violent mixing or agitation occurs.

Referring to FIG. 2, docking station 18 which can be maintained in fixed or movable position consists of member 19 which is normally attached to the floor but which can be mounted on a wall or even supported from the ceiling. Side members 20 and 21 of docking station 18 are normally of equal length and positioned at right angles to each other in an L-shaped manner. These side members or arms are equipped with one or more projecting rails, such as rails 16 and 17, for connection with containers of the invention. Side members 20 and 21 are elevated from the floor sufficiently to permit container 10 (FIG. 1) to be completely rotated around bearing 23 when container 10 is interlocked to docking station 18. Docking station 18 can be adapted for either rotating the container to invert it or to blend, mix or reconstitute materials inside container 10, depending on the type of mixing, blending or vibration desired. Thus, rails 16 and 17 effect positive positioning for quick connect-disconnect and rapid locking. In addition, the rails cause the driving torque to be distributed over a large area when the container is rotated. Thus, the present invention permits the docking station to be centrally located which results in a reduction of capital investment costs with respect to equipment.

Figure 4:
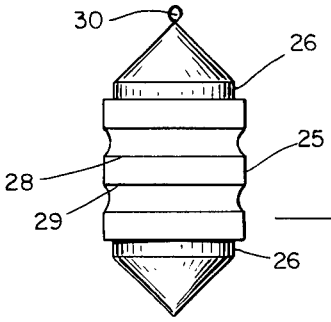
FIG. 4 is a side view of a rectangular frame holding a cylindrical cone-shaped container and illustrates another shape of container which can be utilized in accordance with the present invention.

Referring to FIG. 4, frame 25 is placed around cylindrical shaped container 26 having cone shaped ends. Since frame 25 is equipped with grooved fittings 28 and 29, it can be inserted into the docking station illustrated in FIG. 2. In comparison to container 26 frame or skirt 25 can be quite small. Instead of having the frame around the container the frame can consist of two side walls joined together at one end in an appropriate angle and open at the other end to accept a container, such as a drum, which can be connected to the frame between the two side walls. Utilization of a container inside frame 25 permits all the advantages of fast, gentle, uniform blending inherent with mixing operations using that shape of container. A forklift device or other means, such as a device which will lift container 26 to a docking station.

Figure 5:
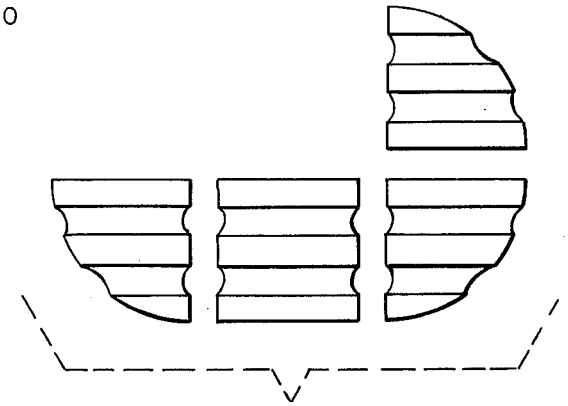
FIG. 5 is a side view of four containers which are shaped to fit inside an airplane fuselage and this figure illustrates still further container shapes which can be utilized in the present invention.

Another container shape which can be utilized in connection with the present invention is illustrated in FIG. 5. In this embodiment four sections of a six section container are illustrated which can be fitted together. These sections are adapted to fit inside an airplane fuselage. The illustrated container sections are equipped with grooved fittings which permit them to be connected with a docking station, such as docking station 18 in FIG. 2.

FIG. 6 illustrates yet another container shape, specifically an octagonal shaped container 33, inside square frame 34 which is equipped with fittings (not shown) necessary for connection with a docking station. It will thus be seen that as long as either the container itself or a frame surrounding container is equipped with necessary fittings for quick connect-disconnect operations with a docking station, a variety of different shapes and types of containers as well as materials for construction of containers can be utilized. In fact, as long as the outside frame 34 is constructed of a rigid material, the internal container itself which is attached to the frame need not be constructed of metal. FIG. 6. If desired, internal container 33 can be made of plastic, rubber, fabric or a similar material. Provided the fittings on a container match the fittings on the arms or side walls of the docking station, the container frame can be either shorter, the same size or longer than the arms or side walls. This fact means that containers of varying sizes, configuration and material construction can be used with the same docking station.

In addition to the mixing and blending operations which are possible by rotation and/or vibration using a docking station, containers of the present invention can be equipped with a mixing bar, such as mixing bar 35 illustrated in FIG. 6. By equipping a docking station with means for engaging end 36 of mixing bar 35, the mixing bar can be rotated when container frame 33 and frame 34 are connected with the docking station. With such a mixing bar internal mixing can occur either independent of or simultaneous with the mixing or blending caused by rotation or vibration of the container by the docking station.

Referring to FIG. 7, container 40 is illustrated which in addition to recessed grooves 42 and 43, the fittings required for connection with a docking station, has vertical channels, such as channel 45, located along each corner edge of the container. As previously explained, grooves 42 and 43 provide fittings necessary for connecting container 40 with a docking station. Such grooves, as well as channel 45, also improve the structural rigidity of the container compared to a perfectly flat side wall rectangular storage bin. A further feature of vertical channel 45 in connection with the elimination of container shifting using vertical tie bars will be referred to below in connection with FIG. 10.

FIG. 7 also illustrates a recessed opening 47 which permits a connection to be made between an internal mixing bar (not shown) and a docking station (not shown). While lifting eye 49 appears in the drawing, container 40 is preferably transported by means of a conventional fork lift truck. Lifting eye 49, which can be on the top and/or bottom of the container, is protected by channels, for example, 50 and 51 described below.

Houseglass-shaped channels 50, 51, 52 and 53 are preferably attached to container 40 as shown in FIG. 7. These channels facilitate the stacking and interlocking of containers and help to improve structural rigidity. Upwardly projecting channels 50 and 51 have a closed hourglass-shaped configuration defined by sidewalls 48a and 48 b as illustrated in FIG. 9. As illustrated on FIG. 8 downwardly projecting channels 52 and 53, on the other hand, have an open hourglass-shaped configuration defined by sidewalls 59*a* and 59*b* adapted to fit into the corresponding closed channels. The hourglass shape is achieved by spacing the sidewalls 48 and 59 further apart at their ends than at their midportions. The difference in size between the channels of FIGS. 8 and 9 is just sufficient to permit them to become easily intermeshed. Because of the configurations of these interlocking channels, containers can be safely stacked one on the other. The channels can be positioned at any suitable angle, e.g., a 45-degree angle, and spaced apart at a distance equal to the width of the tongs on a conventional fork lift truck making it possible for the container to be picked up by inserting the tongs of the fork lift truck into the ends of the channels and. Preferably, the channels are slightly wider even at the narrowest point in their hourglass configuration than the width of the tongs of a fork lift truck. This not only facilitates picking up container 40 using a fork lift truck but facilitates the docking operation because the lateral variance provides for non-critical docking. As grooves 42 and 43 of container 40 (FIG. 7) become engaged with the rails of a docking station some shifting occurs because of the automatic alignment caused by the side wall configuration of the docking station. If channels 52 and 53 are wider even at their narrowest point than the tongs of the lift fork truck, container 40 automatically turns without binding while being held by the fork lift truck and connected with the docking station.

In FIG. 10 several containers are stacked together on pallet 54. Vertical members, such as vertical members 55, 56, 57 and 58, attached to the pallet serve to guide and also retain the containers in their position on the pallet, during movement of the pallet itself. While FIG. 10 illustrates only four containers positioned on a pallet it will be understood that any number of containers can be arranged to fit on a pallet and that the containers can, if desired, be stacked one on the other in layers.

In FIG. 11 U-shaped arms (two L-shaped arms joined together) are attached to a docking station 60. U-shaped arms 62 are actually movable in U-shaped frame 63 to permit a container 65 to be tilted at an angle, e.g. 45°, which is known to provide classic blending action. Suitable locking means such as pins 67 and 68 can be used to retain container 65 at the desired angle while the container is being rotated by docking station 60. Although the U-shaped arms of docking station 60 establish the width of the container which can be used in the docking station, the arms do not limit the depth or height of the container.

From the foregoing, it will be seen that the present invention is well adapted to attain all of the ends and objects hereinabove set forth, together with other advantages which are obvious and which are inherent to the system. With the present invention it is possible to control contamination of products in a plant environment, to reduce plant equipment cleaning costs, to save time required to charge and discharge processing equipment, to use plant space more efficiently, to cut shipping and container costs, and to prevent plant obsolescence when changes occur in products and processes. Accordingly, a significant and major improvement in materials handling procedures for batch operations has been developed which provides for clean, safe, economical and flexible operation.

In accordance with the present invention a container can be connected to or disconnected from a drive station in less than one minute. Most blending and processing cycles require less than 10 minutes. On the basis of 12 minute intervals per batch, it is thus possible to handle five containers in an hour or 40 containers per 8 hour shift. Using 50 cubic foot containers, the output capacity is 2000 cubic feet per shift. What can be accomplished is intermittent "continuous" processing.

One of the advantages of the present invention is the fact that containers of varying size, shape and construction can be adapted for utilization with the docking station by simply attaching a frame to the container which will permit quick connect-disconnect operations with the docking station. Preferred containers have a triple wall construction, such as an exterior layer of aluminum, an intermediate layer of styrofoam and an interior layer of stainless steel. This triple wall construction has certain inherent advantages over a single walled container not only with respect to structural aspects and weight but also with respect to temperature control. Triple wall construction permits impact resistant containers to be built from relatively thin wall layers. Obviously, any desired materials can be used to fabricate the containers including aluminum, magnesium, carbon, stainless steel, plastic, fiberglas and the like.

The strength of three wall construction makes this type of container ideally suited for interplant transportation by conventional means, such as rail, truck or air shipment. To provide even further structural strength the containers in a preferred embodiment have means such as a cable or tie rod attached to each corner or fork lift channel, thereby connecting the top and bottom of the container. This preferred construction permits the containers to be picked up and suspended and, if desired, for the container to have a floating interior shell. Due to the structural strength of the containers they can be positioned in an upright position or in an inverted position. Accordingly, an improved container design is provided which permits empty containers to be forwarded to suppliers for receiving materials sealed inside ready for processing thereby making it possible to eliminate the need for discarding empty drums. The system of the present invention also permits a manufacturer to ship containerized formulations to regional plants for further operations, such as tableting and packaging. The incorporation of a built-in impeller or agitator simplifies the stirring required in connection with formulations which tend to settle after shipment or long storage periods.

The apparatus and process of the present invention can be used in connection with almost any dry bulk or liquid material. The list of materials which can advantageously be handled is practically limitless and would include powders, colors, pigments, minerals, synthetic products, fine and heavy chemicals, dyes, intermediates, resins, molding powders, plastics, liquid adhesives, lacquers, thinners, paints, petrochemicals, food materials such as liquid chocolate, sugar, and the like. For materials which tend to solidify in storage or transit, the apparatus of the present invention can be equipped with special heating devices, such as electrical tape or heating coils. For materials needing refrigeration, the containers can be equipped with means for cooling the contents, such as refrigeration coils.

As previously mentioned, the containers can be equipped with rotating bars which will assist in blending materials, in discharging materials, in breaking up lumps, etc. Conveniently, these rotating bars are mounted in the container with an end arranged to automatically become engaged with a turning mechanism located on the docking station when the container is connected with the docking station. If desired a dispersion device can be incorporated into an agitator bar. Such a device would permit liquid mist to pass through narrow slots in the agitator bar into the material inside the container. This liquid mist could be enveloped in a cascade of tumbling solid particles such that wetting of the shell is prevented. Similar equipment can also be used to introduce a gas into the material being processed. Instead of being used to introduce material into the container, the equipment can also be used to withdraw air from the container to create a vacuum.

To provide for dust free charging and discharging of solid ingredients, containers can be provided with ports that fit dust tight charging and discharging spouts such that ingredients can be added and withdrawn without contaminating either the product or the environment. An advantage of the docking station is that it permits a container to be precisely aligned. This means that a container can be charged from a floor above or discharged to a floor below while being held in precise alignment with a chute or floor opening.

While the illustrated containers are conveniently moved with a conventional lift fork, obviously the containers can be equipped with hoisting eyes, rollers, casters, or other common means for positioning and moving the containers.

Obviously, many other modifications and variations of the invention as hereinbefore set forth can be made without departing from the spirit and scope thereof.

What is claimed is:

1. An enclosed multiwall container comprising: an upper end wall member; a lower end wall member; side wall members; each side wall member connected to said upper end wall member and said lower end wall member; at least one vertical channel member connected to said upper end wall member and said lower end wall member, each said channel member separating adjacent side wall members and turned outwardly to form a recessed corner along adjacent side wall members; at least two adjacent side wall members having horizontal means extending along each side wall member from a recessed corner, said horizontal means adapted for interconnection of the container with V-shaped arms of a retaining device; and said upper end wall member and lower end wall member each having two separate projecting hourglass shaped members positioned parallel to each other, each said hourglass shaped member being narrowest at the midsection of its hourglass shape, and the hourglass shaped member projecting from the upper end wall member are of slightly different size than the hourglass shaped members projecting from the lower end wall member such that hourglass shaped members on different containers will nest with each other when one container is stacked on another.

2. The multiwall container of claim 1 in which the hourglass shaped members are at an angle with respect to said side wall members.

3. The multiwall container of claim 1 in which the side wall members have three layers, the outer layer being metal, the middle layer being plastic and the inner layer being metal.

4. The multiwall container of claim 3 in which the outer layer is aluminum and the inner layer is stainless steel.

5. The multiwall container of claim 1 in which the side wall members have three layers, the outer layer being metal, the middle layer being plastic and the inner layer being plastic.

6. A rectangular multiwall container comprising: an upper end wall member; a lower end wall member; four side wall members, each side wall member connected to said upper end wall member and said lower end wall member; at least one vertical channel member connected to said upper end wall member and said lower end wall member, each said channel member separating adjacent side wall members and turned outwardly to form a recessed corner along adjacent side wall members; at least two adjacent side wall members having horizontal means extending along each side wall member from a recessed corner, said horizontal means adapted for interconnection of the container with right angle arms of a retaining device; and said upper end wall member and lower end wall member each having two separate projecting hourglass shaped members positioned parallel to each other, each said hourglass shaped member being narrowest at the midsection of its hourglass shape, and the hourglass shaped members projecting from the upper end wall member are of slightly different size than the hourglass shaped members projecting from the lower end wall such as that hourglass shaped members on different containers will nest with each other when one container is stacked on another.

7. The multiwall container of claim 6 in which the hourglass shaped members are at an angle with respect to said side wall members.

8. The multiwall container of claim 6 in which the side wall members have three layers, the outer layer being metal, the middle layer being plastic and the inner layer being metal.

9. The multiwall container of claim 8 in which the outer layer is aluminum and the inner layer is stainless steel.

10. The multiwall container of claim 6 in which the side wall members have three layers, the outer layer being metal, the middle layer being plastic and the inner layer being plastic.

* * * * *